US005626690A

United States Patent [19]

Matsuki et al.

[11] Patent Number: 5,626,690

[45] Date of Patent: May 6, 1997

[54] LOW BORON AMORPHOUS ALLOY HAVING EXCELLENT SOFT MAGNETIC CHARACTERISTICS

[75] Inventors: Kensuke Matsuki; Masao Yukumoto; Fumio Kogiku, all of Chiba, Japan

[73] Assignee: Kawasaki Steel Corporation, Japan

[21] Appl. No.: 520,367

[22] Filed: Aug. 28, 1995

[30] Foreign Application Priority Data

Jan. 13, 1995 [JP] Japan ..... 7-003918

[51] Int. Cl.[6] ..... H01F 1/153

[52] U.S. Cl. ..... 148/304; 420/83; 420/117; 420/121

[58] Field of Search ..... 148/304, 403; 420/83, 117, 121

[56] References Cited

FOREIGN PATENT DOCUMENTS

| | | | |
|---|---|---|---|
| 53-102219 | 9/1978 | Japan | 148/304 |
| 57-169208 | 10/1982 | Japan | 148/304 |
| 57-193005 | 11/1982 | Japan | 148/304 |
| 57-193006 | 11/1982 | Japan | 148/304 |

*Primary Examiner*—John Sheehan
*Attorney, Agent, or Firm*—Austin R. Miller

[57] ABSTRACT

A low boron amorphous alloy having excellent soft magnetic characteristics, composed of B: about 6–10 at %, Si: about 10–17 at %, P: about 0.02–2 at % and the balance Fe and incidental impurities. The invention lowers production costs because the content of expensive boron is reduced.

4 Claims, 2 Drawing Sheets

LOW BORON AMORPHOUS ALLOY HAVING EXCELLENT SOFT MAGNETIC CHARACTERISTICS

BACKGROUND OF THE INVENTION

1. Field of the Invention

The present invention relates to a low boron amorphous alloy having excellent soft magnetic characteristics, and more specifically to a low boron amorphous alloy in which the boron content is advantageously reduced without deteriorating the magnetic characteristics of the alloy.

2. Description of the Related Art

Various Fe-Si-B alloy compositions are known to possess excellent soft magnetic characteristics.

For example, U.S. Pat. No. 3,856,513 discloses an amorphous alloy containing at least 80 at % Fe, at least 10 at % B and no more than 6 at % Si. Further, U.S. Pat. No. 235,064 discloses an amorphous alloy composed of 77–80 at % Fe, 12–16 at % B and 5–10 at % Si.

Almost all known Fe-Si-B amorphous alloys contain at least 10 at % B, as B is very important to the amorphous property of such alloys. The higher the B content, the stronger the amorphous forming capability of the alloys, whereby thermal stability is improved. Thus, it has been conventionally believed that a B content of at least 10 at % is required to produce excellent soft magnetic characteristics in Fe-Si-B amorphous alloys.

Further, both iron loss and magnetic flux density of conventional Fe-Si-B amorphous alloys containing less than 10 at % B are inferior to alloys containing at least 10 at % B.

Because of the high cost of B, there have been attempts to improve Fe-Si-B amorphous alloys containing less than 10 at % B. For example, C has been added to stabilize age deterioration and to improve amorphous property forming capabilities (Japanese Patent Unexamined Publication No. 57-145964 (1982) and Japanese Patent Unexamined Publication No. 58-42751 (1983)), Mn has been added to improve surface treatment properties (Japanese Patent Unexamined Publication No. 61-136660 (1986), and Cr has been added to improve casting properties (Japanese Patent Unexamined Publication No. 58-210154 (1983)). However, maintaining excellent soft magnetic characteristics in Fe-Si-B alloys containing less than 10 at % B has not been accomplished in the art.

SUMMARY OF THE INVENTION

An object of the present invention is to provide a low boron amorphous alloy having excellent soft magnetic characteristics.

Our investigations led to the discovery that the addition of a small amount of P (0.02–2 at %)accomplishes the above-described described object. More specifically, we discovered that this small addition of P greatly improves the surface roughness of a cast alloy, thereby maintaining excellent soft magnetic characteristics even at a B content below that of conventional amorphous alloys.

That is, the present invention relates to a low boron amorphous alloy having excellent soft magnetic characteristics and having the following composition:

B: about 6–10 at %;

Si: about 10–17 at %;

P: about 0.02–2 at %; and the balance Fe and incidental impurities. Accordingly it is important that the balance shall consist essentially of Fe and incidental impurities, and that the alloy of this invention shall consist essentially of the above atomic percentage of B, Si and P.

Further, the present invention relates to a low boron amorphous alloy having excellent soft magnetic characteristics and having the following composition:

B: about 6–10 at %;

Si: about 10–17 at %;

P: about 0.02–2 at %;

C: about 0.1–2 at %; and the balance Fe and incidental impurities. Accordingly it is important that the balance shall consist essentially of Fe and incidental impurities, and that the alloy of this invention shall consist essentially of the above atomic percentage of B, Si, P and C.

When low boron amorphous alloys according to the invention are cast into sheets by a single roll method or other conventional technique, the surface roughness of the cast sheet is reduced to where the mean centerline surface roughness Ra on the casting mold side is 0.8 μm or less.

DETAILED DESCRIPTION OF THE INVENTION

Figure 1:
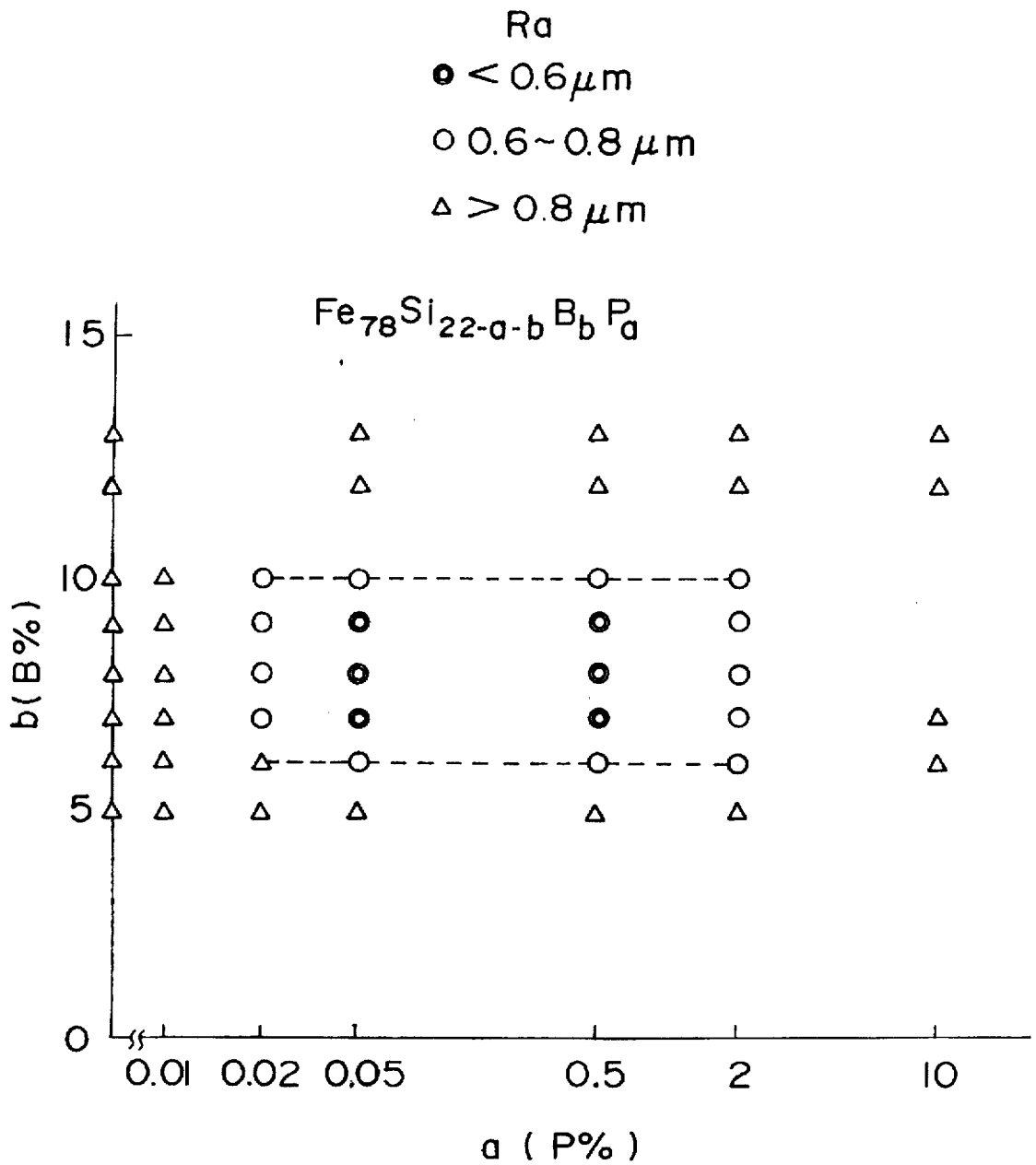
FIG. 1 is a graph showing the relationship between B and P contents and surface roughness in a Fe-Si-B amorphous alloy.

FIG. 1 shows the results of an investigation into the effect of alloy composition on casting mold side surface roughness of cast alloys. This investigation was conducted on alloys comprising 78 at % Fe, and various quantities of Si, P and B. The alloys were made amorphous by conventional immediate-cooling techniques, such as the single roll method.

As seen in FIG. 1, the addition of P provides improved surface roughness at reduced B contents.

That is, an excellent mean centerline roughness of Ra $\leqq 0.8$ μm is obtained when P content is about 0.02–2 at % and B content is about 6–10 at %.

When alloys having compositions as described above are made amorphous using a conventional immediate-cooling device such as a single roll or the like, the surface roughness of resulting cast alloys can be limited to about 0.8 μm in terms of mean centerline roughness Ra on the casting mold side, whereby magnetic characteristics are improved.

It is preferable that the surface roughness Ra be about 0.6 μm or less to obtain even better magnetic characteristics.

Figure 2:
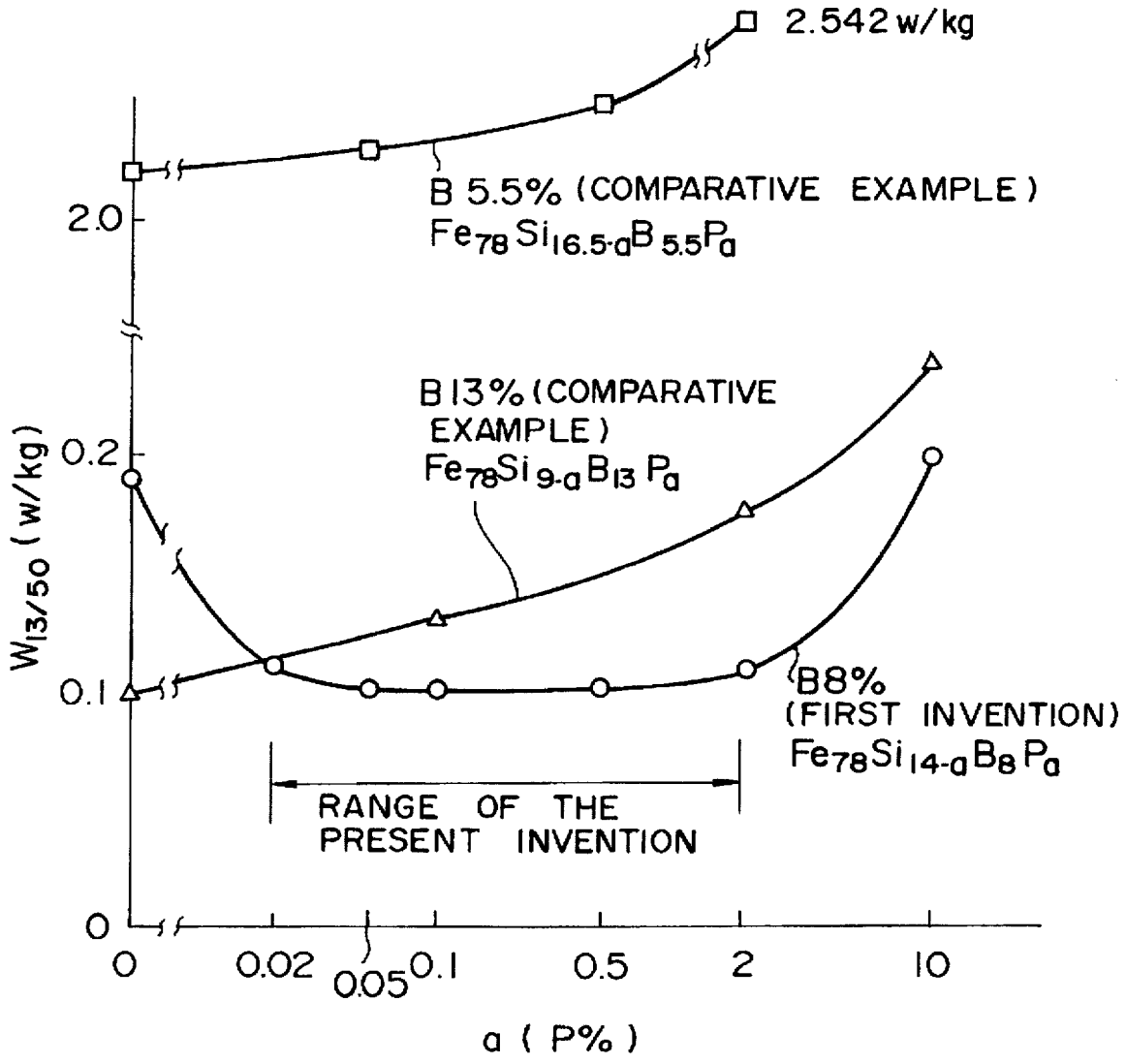
FIG. 2 is a graph showing the relationship between P content and iron loss in Fe-Si-B amorphous alloys having three different B contents.

FIG. 2 shows the results of an investigation into the relationship between P content and iron loss with respect to alloy sheets having the following compositions: $Fe_{78}Si_{9-a}B_{13}P_a$ (comparative example having a large B content), $Fe_{78}Si_{14-a}B_8P_a$ (example of the invention) and $Fe_{78}Si_{16.5-a}B_{5.5}P_a$ (comparative example having a small B content). As shown in FIG. 2, when B content is about 8 at %, excellent iron loss characteristics are obtained over a P content range of about 0.02–2 at %.

Although the thickness of the alloy sheet is not particularly limited, if cast too thin, surface roughness deteriorates and magnetic flux density decreases. If cast too thick, the rate of cooling is insufficient and iron loss deteriorates. Thus, it is preferable that the sheet thickness be about 17–25 μm so that such problems are eliminated.

A description will be given below of suitable contents for the elements comprising the amorphous alloy of the invention.

B: about 6–10 at %

The upper limit of B content in the invention is about 10 at %. If the B content exceeds about 10 at %, the surface roughness of the alloy sheet increases whereby soft magnetic characteristics deteriorate. Further, production costs soar due to the large quantity of expensive ferroboron used.

The lower B content limit is about 6 at %, as making an amorphous alloy becomes difficult when the B content is below about 6 at %.

A B content of about 7.5–9.5 at % is preferred when the cooling capacity limits of industrial production machines and material costs are taken into account.

Si: about 10–17 at %

Si contributes to reduced magnetostriction and to improved thermal stability of the cast alloy. When Si content is less than about 10 at %, the reduction of magnetostriction is insufficient, whereas when Si content exceeds about 17 at %, sheet brittleness becomes a problem. Thus, Si content is limited to about 10–17 at %.

P: about 0.02–2 at %

In this invention, P is a particularly important element as it is indispensable to the realization of excellent surface roughness and soft magnetic characteristics. When P content is below about 0.02 at %, surface roughness fails to improve sufficiently, whereas when P content exceeds about 2 at %, sheet brittleness increases and thermal stability declines. Thus, P content is limited to a range of about 0.02–2 at %.

In a wide sheet which requires strict brittleness control and excellent thermal stability, it is preferable that P content be about 0.02–0.5 at %.

C: about 0.1–2 at %

C improves soft magnetic characteristics and stabilizes the yield of B when P is added. However, when C content is less than about 0.1 at %, these beneficial effects are not sufficiently realized, whereas when C content exceeds about 2 at %, thermal stability of the sheet is reduced. Thus, C is contained in a range of about 0.1–2 at %.

To maintain product stability in commercial production, it is preferable that C content be within a range of about 0.1–1 at %.

The invention will now be described through illustrative examples. The examples are not intended to limit the scope of the invention defined in the solicited claims.

Various molten alloys having the compositions shown in Table 1 were cast onto the surface a cooling roll (roll diameter: 280 mm) rotating at a peripheral speed of 27 m/sec, thereby producing amorphous alloy sheets.

The following characteristics were evaluated on each amorphous alloy sheet: roughness on the casting mold side, iron loss, magnetic flux density and sheet thickness. The results of the evaluations are shown in Table 1.

As revealed in Table 1, when B content was 10 at % or less (below conventional B content) and P was added in accordance with the present invention, excellent soft magnetic characteristics (comparing favorably to those of conventional alloys having large B contents) were obtained.

According to the present invention, a low boron amorphous alloy having soft magnetic characteristics of the same quality as high boron amorphous alloys can be obtained. Consequently, the invention requires less B, thereby sharply reducing production costs.

Although this invention has been described in connection with specific forms thereof, it will be appreciated that equivalents may be substituted for the specific elements described herein without departing from the spirit and scope of the invention as defined in the appended claims.

TABLE 1

| Specimen No. | Composition (at %) | Surface Roughness Ra (μm) | (1) Iron Loss $W_{13/50}$ (W/kg) | Magnetic Flux Density $B_8$ (T) | Thickness of Sheet (μm) | Reference |
|---|---|---|---|---|---|---|
| 1 | $Fe_{78}Si_9B_{13}$ | 1.0 | 0.100 | 1.530 | 25 | Conventional Example |
| 2 | $Fe_{78}Si_{13.9}B_8P_{0.1}$ | 0.25 | 0.101 | 1.521 | 23 | Example of the Invention |
| h3 | $Fe_{78}Si_{12.9}B_9P_{0.1}$ | 0.36 | 0.095 | 1.532 | 24 | Example of the Invention |
| 4 | $Fe_{78}Si_{13.4}B_{8.5}P_{0.1}$ | 0.32 | 0.103 | 1.524 | 22 | Example of the Invention |
| 5 | $Fe_{78}Si_{14.4}B_{9.5}P_{0.1}$ | 0.36 | 0.095 | 1.509 | 23 | Example of the Invention |
| 6 | $Fe_{78}Si_{11.9}B_9P_{0.1}C_1$ | 0.38 | 0.095 | 1.532 | 24 | Example of the Invention |
| 7 | $Fe_{78}Si_{9.9}B_9P_{0.1}C_1$ | 0.28 | 0.105 | 1.540 | 23 | Example of the Invention |
| 8 | $Fe_{78}Si_{16.4}B_{5.5}P_{0.1}$ | 1.50 | 2.305 | 0.985 | 24 | Comparative Example |
| 9 | $Fe_{78}Si_{10.9}B_{12}P_{0.1}$ | 0.95 | 0.121 | 1.505 | 25 | Comparative Example |
| 10 | $Fe_{78}Si_{8.9}B_{13}P_{0.1}$ | 0.92 | 0.132 | 1.506 | 26 | Comparative Example |
| 11 | $Fe_{78}Si_{13.5}B_{8.5}$ | 1.05 | 0.195 | 1.479 | 23 | Comparative Example |
| 12 | $Fe_{78}Si_{12.5}B_{9.5}$ | 0.93 | 0.184 | 1.482 | 25 | Comparative Example |
| 13 | $Fe_{78}Si_{13.98}B_8P_{0.02}$ | 0.61 | 0.101 | 1.500 | 18 | Example of the Invention |
| 14 | $Fe_{78}Si_{13.8}B_8P_{0.2}$ | 0.65 | 0.102 | 1.505 | 19 | Example of the Invention |
| 15 | $Fe_{78}Si_{12}B_8P_2$ | 0.79 | 0.106 | 1.500 | 20 | Example of the Invention |

TABLE 1

(2)

| Specimen No. | Composition (at %) | Surface Roughness Ra (μm) | Iron Loss $W_{13/50}$ (W/kg) | Magnetic Flux Density $B_8$ (T) | Thickness of Sheet (μm) | Reference |
|---|---|---|---|---|---|---|
| 16 | $Fe_{78}Si_{12.98}B_8P_{0.02}C_1$ | 0.41 | 0.102 | 1.504 | 20 | Example of the Invention |
| 17 | $Fe_{78}Si_{12.9}B_8P_{0.1}C_1$ | 0.53 | 0.101 | 1.505 | 19 | Example of the Invention |
| 18 | $Fe_{78}Si_{12.8}B_8P_{0.2}C_1$ | 0.54 | 0.103 | 1.506 | 17 | Example of the Invention |
| 19 | $Fe_{78}Si_{11}B_8P_2Cl_1$ | 0.69 | 0.105 | 1.510 | 19 | Example of the Invention |
| 20 | $Fe_{78}Si_{12.98}B_9P_{0.02}$ | 0.55 | 0.102 | 1.512 | 19 | Example of the Invention |
| 21 | $Fe_{78}Si_{12.8}B_9P_{0.2}$ | 0.58 | 0.098 | 1.514 | 18 | Example of the Invention |
| 22 | $Fe_{78}Si_{11}B_9P_2$ | 0.52 | 0.096 | 1.515 | 18 | Example of the Invention |
| 23 | $Fe_{78}Si_{11.98}B_9P_{0.02}C_1$ | 0.42 | 0.097 | 1.520 | 20 | Example of the Invention |
| 24 | $Fe_{78}Si_{11.8}B_9P_{0.2}C_1$ | 0.51 | 0.101 | 1.518 | 20 | Example of the Invention |
| 25 | $Fe_{78}Si_{11}B_9P_2C_1$ | 0.58 | 0.095 | 1.515 | 20 | Example of the Invention |
| 26 | $Fe_{78}Si_{11.98}B_{10}P_{0.02}$ | 0.50 | 0.094 | 1.520 | 19 | Example of the Invention |
| 27 | $Fe_{78}Si_{11.8}B_{10}P_{0.2}$ | 0.51 | 0.097 | 1.521 | 18 | Example of the Invention |
| 28 | $Fe_{78}Si_{10}B_{10}P_2$ | 0.53 | 0.098 | 1.523 | 23 | Example of the Invention |
| 29 | $Fe_{78}Si_{10.98}B_{10}P_{0.02}C_1$ | 0.43 | 0.095 | 1.524 | 19 | Example of the Invention |
| 30 | $Fe_{78}Si_{10.8}B_{10}P_{0.2}C_1$ | 0.42 | 0.094 | 1.520 | 19 | Example of the Invention |

TABLE 1

(3)

| Specimen No. | Composition (at %) | Surface Roughness Ra (μm) | Iron Loss $W_{13/50}$ (W/kg) | Magnetic Flux Density $B_8$ (T) | Thickness of Sheet (μm) | Reference |
|---|---|---|---|---|---|---|
| 31 | $Fe_{78}Si_9B_{10}P_2C_1$ | 0.54 | 0.098 | 1.518 | 20 | Example of the Invention |
| 32 | $Fe_{76}Si_{14.98}B_9P_{0.02}$ | 0.65 | 0.110 | 1.509 | 19 | Example of the Invention |
| 33 | $Fe_{76}Si_{14.8}B_9P_{0.2}$ | 0.64 | 0.108 | 1.508 | 18 | Example of the Invention |
| 34 | $Fe_{76}Si_{13}B_9P_2$ | 0.62 | 0.109 | 1.511 | 20 | Example of the Invention |
| 35 | $Fe_{76}Si_{13.98}B_9P_{0.02}C_1$ | 0.51 | 0.109 | 1.512 | 19 | Example of the Invention |
| 36 | $Fe_{76}Si_{13.8}B_9P_{0.2}C_1$ | 0.62 | 0.111 | 1.509 | 20 | Example of the Invention |
| 37 | $Fe_{76}Si_{12}B_9P_2C_1$ | 0.66 | 0.105 | 1.508 | 21 | Example of the Invention |
| 38 | $Fe_{76}Si_{14.48}B_{9.5}P_{0.02}$ | 0.43 | 0.080 | 1.503 | 18 | Example of the Invention |
| 39 | $Fe_{76}Si_{14.3}B_{9.5}P_{0.2}$ | 0.44 | 0.078 | 1.501 | 18 | Example of the Invention |
| 40 | $Fe_{76}Si_{12.5}B_{9.5}P_2$ | 0.57 | 0.083 | 1.505 | 18 | Example of the Invention |
| 41 | $Fe_{76}Si_{13.48}B_{9.5}P_{0.02}C_1$ | 0.49 | 0.095 | 1.503 | 19 | Example of the Invention |
| 42 | $Fe_{76}Si_{13.3}B_{9.5}P_{0.2}C_1$ | 0.58 | 0.093 | 1.504 | 21 | Example of the Invention |
| 43 | $Fe_{76}Si_{11.5}B_{9.5}P_2C_1$ | 0.53 | 0.097 | 1.505 | 19 | Example of the Invention |
| 44 | $Fe_{76}Si_{13.98}B_{10}P_{0.02}$ | 0.57 | 0.105 | 1.504 | 19 | Example of the Invention |
| 45 | $Fe_{76}Si_{13.8}B_{10}P_{0.2}$ | 0.53 | 0.102 | 1.505 | 21 | Example of the Invention |

TABLE 1

(4)

| Specimen No. | Composition (at %) | Surface Roughness Ra (μm) | Iron Loss $W_{13/50}$ (W/kg) | Magnetic Flux Density $B_8$ (T) | Thickness of Sheet (μm) | Reference |
|---|---|---|---|---|---|---|
| 46 | $Fe_{76}Si_{12}B_{10}P_2$ | 0.64 | 0.099 | 1.501 | 20 | Example of the Invention |
| 47 | $Fe_{76}Si_{12.98}B_{10}P_{0.02}C_1$ | 0.48 | 0.098 | 1.503 | 19 | Example of the Invention |
| 48 | $Fe_{76}Si_{12.8}B_{10}P_{0.2}C_1$ | 0.42 | 0.095 | 1.503 | 18 | Example of the Invention |
| 49 | $Fe_{76}Si_{11}B_{10}P_2Cl_1$ | 0.51 | 0.093 | 1.500 | 18 | Example of the Invention |
| 50 | $Fe_{80}Si_{11.98}B_8P_{0.02}$ | 0.64 | 0.096 | 1.345 | 18 | Example of the Invention |
| 51 | $Fe_{80}Si_{11.8}B_8P_{0.2}$ | 0.62 | 0.095 | 1.541 | 20 | Example of the Invention |
| 52 | $Fe_{80}Si_{10}B_8P_2$ | 0.59 | 0.102 | 1.525 | 20 | Example of the Invention |
| 53 | $Fe_{80}Si_{11.88}B_8P_{0.02}C_{0.1}$ | 0.55 | 0.098 | 1.542 | 23 | Example of the Invention |
| 54 | $Fe_{80}Si_{11.7}B_8P_{0.2}C_{0.1}$ | 0.61 | 0.100 | 1.540 | 21 | Example of the Invention |
| 55 | $Fe_{80}Si_{9.9}B_1P_2C_{0.1}$ | 0.55 | 0.102 | 1.523 | 20 | Example of the Invention |
| 56 | $Fe_{80}Si_{9.98}B_8P_{0.02}C_2$ | 0.49 | 0.096 | 1.541 | 19 | Example of the Invention |
| 57 | $Fe_{80}Si_{9.8}B_8P_{0.2}C_2$ | 0.50 | 0.098 | 1.538 | 19 | Example of the Invention |
| 58 | $Fe_{80}Si_8B_8P_2C_2$ | 0.51 | 0.104 | 1.526 | 18 | Example of the Invention |
| 59 | $Fe_{80}Si_{10.98}B_9P_{0.02}$ | 0.63 | 0.092 | 1.542 | 21 | Example of the Invention |
| 60 | $Fe_{80}Si_{10.8}B_9P_{0.2}$ | 0.61 | 0.094 | 1.543 | 19 | Example of the Invention |

TABLE 1

(5)

| Specimen No. | Composition (at %) | Surface Roughness Ra (μm) | Iron Loss $W_{13/50}$ (W/kg) | Magnetic Flux Density $B_8$ (T) | Thickness of Sheet (μm) | Reference |
|---|---|---|---|---|---|---|
| 61 | $Fe_{80}Si_9B_9P_2$ | 0.69 | 0.103 | 1.522 | 22 | Example of the Invention |
| 62 | $Fe_{80}Si_{10.88}B_9P_{0.02}C_{0.1}$ | 0.55 | 0.094 | 1.545 | 23 | Example of the Invention |
| 63 | $Fe_{80}Si_{10.7}B_9P_{0.2}C_{0.1}$ | 0.60 | 0.099 | 1.541 | 23 | Example of the Invention |
| 64 | $Fe_{80}Si_{8.9}B_9P_2C_{0.1}$ | 0.62 | 0.102 | 1.524 | 22 | Example of the Invention |
| 65 | $Fe_{80}Si_{8.98}B_9P_{0.02}C_2$ | 0.50 | 0.095 | 1.546 | 22 | Example of the Invention |
| 66 | $Fe_{80}Si_{8.8}B_9P_{0.2}C_2$ | 0.48 | 0.096 | 1.542 | 21 | Example of the Invention |
| 67 | $Fe_{80}Si_7B_9P_2C_2$ | 0.65 | 0.101 | 1.521 | 18 | Example of the Invention |
| 68 | $Fe_{80}Si_{9.98}B_{10}P_{0.02}$ | 0.64 | 0.088 | 1.541 | 19 | Example of the Invention |
| 69 | $Fe_{80}Si_{9.8}B_{10}P_{0.2}$ | 0.69 | 0.087 | 1.540 | 23 | Example of the Invention |
| 70 | $Fe_{80}Si_8B_{10}P_2$ | 0.72 | 0.099 | 1.523 | 19 | Example of the Invention |
| 71 | $Fe_{80}Si_{9.88}B_{10}P_{0.02}C_{0.1}$ | 0.68 | 0.089 | 1.545 | 18 | Example of the Invention |
| 72 | $Fe_{80}Si_{9.7}B_{10}P_{0.2}C_{0.1}$ | 0.61 | 0.087 | 1.546 | 22 | Example of the Invention |
| 73 | $Fe_{80}Si_{7.9}B_{10}P_2C_{0.1}$ | 0.57 | 0.100 | 1.522 | 20 | Example of the Invention |
| 74 | $Fe_{80}Si_{7.98}B_{10}P_{0.02}C_2$ | 0.49 | 0.094 | 1.545 | 21 | Example of the Invention |
| 75 | $Fe_{80}Si_{7.8}B_{10}P_{0.2}C_2$ | 0.48 | 0.095 | 1.547 | 21 | Example of the Invention |

TABLE 1

(6)

| Specimen No. | Composition (at %) | Surface Roughness Ra (μm) | Iron Loss $W_{13/50}$ (W/kg) | Magnetic Flux Density $B_8$ (T) | Thickness of Sheet (μm) | Reference |
|---|---|---|---|---|---|---|
| 76 | $Fe_{80}Si_6B_{10}P_2C_2$ | 0.55 | 0.102 | 1.526 | 22 | Example of the Invention |
| 77 | $Fe_{78}Si_{13.88}B_8P_{0.02}C_{0.1}$ | 0.59 | 0.094 | 1.535 | 19 | Example of the Invention |
| 78 | $Fe_{78}Si_{13.7}B_8P_{0.2}C_{0.1}$ | 0.68 | 0.098 | 1.532 | 23 | Example of the Invention |
| 79 | $Fe_{78}Si_{11.9}B_8P_2C_{0.1}$ | 0.72 | 0.100 | 1.515 | 18 | Example of the Invention |
| 80 | $Fe_{78}Si_{1.98}B_8P_{0.02}C_2$ | 0.75 | 0.092 | 1.534 | 19 | Example of the Invention |
| 81 | $Fe_{78}Si_{11.8}B_8P_{0.2}C_2$ | 0.71 | 0.091 | 1.532 | 20 | Example of the Invention |
| 82 | $Fe_{78}Si_{10}B_8P_2C_2$ | 0.69 | 0.102 | 1.516 | 18 | Example of the Invention |
| 83 | $Fe_{78}Si_{12.88}B_9P_{0.02}C_{0.1}$ | 0.51 | 0.096 | 1.536 | 18 | Example of the Invention |
| 84 | $Fe_{78}Si_{12.7}B_9P_{0.2}C_{0.1}$ | 0.57 | 0 .094 | 1.532 | 22 | Example of the Invention |
| 85 | $Fe_{78}Si_{10.9}B_9P_2C_{0.1}$ | 0.59 | 0.101 | 1.518 | 23 | Example of the Invention |
| 86 | $Fe_{78}Si_{10.98}B_9P_{0.02}C_2$ | 0.57 | 0.095 | 1.538 | 18 | Example of the Invention |
| 87 | $Fe_{78}Si_{10.8}B_9P_{0.2}C_2$ | 0.58 | 0.093 | 1.532 | 19 | Example of the Invention |
| 88 | $Fe_{78}Si_9B_9P_2C_2$ | 0.58 | 0.103 | 1.513 | 23 | Example of the Invention |
| 89 | $Fe_{78}Si_{11.88}B_{10}P_{0.02}C_{0.1}$ | 0.65 | 0 .093 | 1.536 | 21 | Example of the Invention |
| 90 | $Fe_{78}Si_{11.7}B_{10}P_{0.2}C_{0.1}$ | 0.67 | 0.094 | 1.531 | 20 | Example of the Invention |

TABLE 1

(7)

| Specimen No. | Composition (at %) | Surface Roughness Ra (μm) | Iron Loss $W_{13/50}$ (W/kg) | Magnetic Flux Density $B_8$ (T) | Thickness of Sheet (μm) | Reference |
|---|---|---|---|---|---|---|
| 91 | $Fe_{78}Si_{9.9}B_{10}P_2C_{0.1}$ | 0.70 | 0.100 | 1.514 | 21 | Example of the Invention |
| 92 | $Fe_{78}Si_{9.98}B_{10}P_{0.02}C_2$ | 0.52 | 0.092 | 1.538 | 23 | Example of the Invention |
| 93 | $Fe_{78}Si_{9.8}B_{10}P_{0.2}C_2$ | 0.54 | 0.093 | 1.534 | 22 | Example of the Invention |
| 94 | $Fe_{78}Si_8B_{10}P_2C_2$ | 0.55 | 0.101 | 1.513 | 23 | Example of the Invention |
| 95 | $Fe_{76}Si_{14.38}B_{9.5}P_{0.02}C_{0.1}$ | 0.64 | 0.078 | 1.520 | 20 | Example of the Invention |
| 96 | $Fe_{76}Si_{14.2}B_{9.5}P_{0.2}C_{0.1}$ | 0.63 | 0.082 | 1.515 | 18 | Example of the Invention |
| 97 | $Fe_{76}Si_{12.4}B_{9.5}P_2C_{0.1}$ | 0.70 | 0.088 | 1.490 | 18 | Example of the Invention |
| 98 | $Fe_{76}Si_{12.48}B_{9.5}P_{0.02}C_2$ | 0.55 | 0.075 | 1.521 | 19 | Example of the Invention |
| 99 | $Fe_{76}Si_{12.3}B_{9.5}P_{0.2}C_2$ | 0.54 | 0.076 | 1.518 | 22 | Example of the Invention |
| 100 | $Fe_{76}Si_{10.5}B_{9.5}P_2C_2$ | 0.59 | 0.079 | 1.491 | 21 | Example of the Invention |

What is claimed is:

1. A low boron amorphous alloy having excellent soft magnetic characteristics, consisting of:

about 6–10 at % B;

about 10–17 at % Si;

about 0.02–2 at % P; and the balance Fe and incidental impurities.

2. A low boron amorphous alloy having excellent soft magnetic characteristics, consisting of:

about 6–10 at % B;

about 10–17 at % Si;

about 0.02–2 at % P;

about 0.1–2 at % C; and the balance Fe and incidental impurities.

3. A low boron amorphous alloy cast sheet having excellent soft magnetic characteristics and having an alloy composition according to claim 1, wherein said cast sheet has a mean centerline surface roughness Ra on the casting mold side of about 0.8 μm or less.

4. A low boron amorphous alloy cast sheet having excellent soft magnetic characteristics and having an alloy composition according to claim 2, wherein said cast sheet has a mean centerline surface roughness Ra on the casting mold side of about 0.8 μm or less.

* * * * *

UNITED STATES PATENT AND TRADEMARK OFFICE

CERTIFICATE OF CORRECTION

PATENT NO. : 5,626,690

DATED : May 6, 1997

INVENTOR(S) : Kensuke Matsuki et al

It is certified that error appears in the above-indentified patent and that said Letters Patent is hereby corrected as shown below:

In Columns 3 and 4, at Table 1, under the subheading "Specimen No.", third row, please change "h3" to --3--;

under the subheading "Composition (at %)", fifth row, please change "$Fe_{78}Si_{14.4}B_{9.5}P_{0.1}$" to --$Fe_{76}Si_{14.4}B_{9.5}P_{0.1}$--; and under the same subheading, seventh row, please change "$Fe_{78}Si_{9.9}B_9P_{0.1}C_1$" to --$Fe_{79}Si_{9.9}B_9P_{0.1}C_1$--.

In Columns 5 and 6, at Table 1 (2), under the subheading "Composition (at %)", tenth row, please change "$Fe_{78}Si_{11}B_9P_2C_1$" to --$Fe_{78}Si_{10}B_9P_2C_1$--;

at Table 1 (4), under the subheading "Magnetic Flux Density $B_8$ (T), fifth row, please change "1.345" to --1.545--; and under the subheading "Composition (at %)", tenth row, please change "$Fe_{80}Si_{9.9}B_1P_2C_{0.1}$" to --$Fe_{80}Si_{9.9}B_8P_2C_{0.1}$--.

UNITED STATES PATENT AND TRADEMARK OFFICE

CERTIFICATE OF CORRECTION

PATENT NO. : 5,626,690

DATED : May 6, 1997

INVENTOR(S) : Kensuke Matsuki et al

It is certified that error appears in the above-indentified patent and that said Letters Patent is hereby corrected as shown below:

In Columns 7 and 8, under Table 1 (6), under the subheading "Composition (at %)", fifth row, please change "$Fe_{78}Si_{1.98}B_8P_{0.02}C_2$" to --$Fe_{78}Si_{11.98}B_8P_{0.02}C_2$--.

Signed and Sealed this

Second Day of September, 1997

*Attest:*

*Attesting Officer*

BRUCE LEHMAN

*Commissioner of Patents and Trademarks*